US008402800B1

(12) United States Patent
Hester

(10) Patent No.: US 8,402,800 B1
(45) Date of Patent: Mar. 26, 2013

(54) KEY WITH RELEASABLE SHACKLE

(76) Inventor: David D. Hester, Miami, FL (US)

( * ) Notice: Subject to any disclaimer, the term of this patent is extended or adjusted under 35 U.S.C. 154(b) by 0 days.

(21) Appl. No.: 13/409,364

(22) Filed: Mar. 1, 2012

(51) Int. Cl.
*E05B 19/04* (2006.01)

(52) U.S. Cl. ..... 70/408; 70/456 R; 70/459

(58) Field of Classification Search ..... 70/395, 70/408, 456 R–459
See application file for complete search history.

(56) References Cited

U.S. PATENT DOCUMENTS

| | | | | | |
|---|---|---|---|---|---|
| 470,997 | A | * | 3/1892 | Fairchild | 401/52 |
| 765,823 | A | * | 7/1904 | Erb | 119/863 |
| 1,276,122 | A | * | 8/1918 | Scheid | 119/866 |
| 1,373,867 | A | * | 4/1921 | Connor | 70/456 R |
| 1,402,072 | A | * | 1/1922 | Johnson | 70/456 R |
| 1,600,118 | A | * | 9/1926 | Long | 70/456 R |
| 1,852,950 | A | | 5/1929 | Amrhein | |
| 1,724,003 | A | * | 8/1929 | Chamberlain | 24/716 |
| 2,048,599 | A | * | 7/1936 | Collins | 70/456 R |
| 2,049,610 | A | * | 8/1936 | Guidry | 70/459 |
| 2,055,163 | A | * | 9/1936 | Weible | 70/456 R |
| 2,084,260 | A | * | 6/1937 | Schupbach | 70/459 |
| 2,090,962 | A | * | 8/1937 | Peters | 70/456 R |
| 2,098,694 | A | * | 11/1937 | Schraysshuen | 70/459 |
| 2,179,524 | A | * | 11/1939 | Schoeninger | 70/459 |
| 2,188,367 | A | * | 1/1940 | Loercher | 70/459 |
| 2,241,358 | A | * | 5/1941 | Schupbach | 70/459 |
| 2,294,808 | A | * | 9/1942 | Schupbach | 70/459 |
| 2,551,384 | A | * | 5/1951 | Middleton et al. | 16/87.2 |
| 2,551,564 | A | * | 5/1951 | Marien | 70/459 |
| 2,564,242 | A | * | 8/1951 | Wendt | 206/37.8 |
| 2,600,749 | A | | 6/1952 | Gallagher | |
| 2,620,650 | A | * | 12/1952 | Cotti | 70/459 |
| 2,801,038 | A | * | 7/1957 | Hamel | 224/103 |
| 2,877,640 | A | * | 3/1959 | Anderson | 70/459 |
| 2,932,963 | A | * | 4/1960 | Walker | 70/408 |
| 3,315,504 | A | * | 4/1967 | Billings, Jr. | 70/408 |
| 3,541,818 | A | | 7/1968 | Dana | |
| 3,430,470 | A | * | 3/1969 | Muckleston | 70/459 |
| 3,481,169 | A | | 12/1969 | Rossi | |
| 3,797,291 | A | | 3/1974 | Simorghi | |
| 3,933,009 | A | * | 1/1976 | Ireland | 63/12 |
| 4,176,534 | A | | 12/1979 | Denney | |
| 4,317,638 | A | * | 3/1982 | Klaber | 401/195 |
| 5,341,662 | A | * | 8/1994 | MacDonald | 70/456 R |
| 5,477,714 | A | * | 12/1995 | Bishop | 70/459 |
| D490,236 | S | | 5/2004 | Howard | |
| 7,014,444 | B2 | | 3/2006 | Dumstorff et al. | |
| 7,877,844 | B2 | * | 2/2011 | Nichols et al. | 24/3.11 |
| 2006/0090528 | A1 | | 5/2006 | Moening | |
| 2007/0220936 | A1 | | 9/2007 | Miyata et al. | |
| 2011/0302970 | A1 | * | 12/2011 | Amron | 70/456 R |

* cited by examiner

*Primary Examiner* — Suzanne Barrett
(74) *Attorney, Agent, or Firm* — Assouline & Berlow, PA; Loren Donald Pearson

(57) ABSTRACT

A key assembly with a releasable shackle allows a key to be attached and released from a closed loop or key chain. The key is similar to convention keys but does not have a closed shackle. A gap is formed in the shackle to define an opening. A gate that can be opened or closed releasable closes the gap. The gate is opened to add or remove the key from the loop. The gate is closed to lock the key on the loop. The gate can be formed in a number of manners including a wire gate, as flexible resilient gate, a hinged gate, or as a cuff.

4 Claims, 8 Drawing Sheets

KEY WITH RELEASABLE SHACKLE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention relates to keys and devices for attaching keys to key rings.

2. Description of the Related Art

Keys are used to open locks. Keys are sized to be large enough to operate locks but small enough that they can fit in a pocket. A typical key is about five to nine centimeters (5-9 cm) long. The small size of keys makes keys easy to lose.

A typical key has a fixed shackle on its bow. A key ring can be fed through the fixed shackle to secure the key on the key ring.

When multiple keys are on a key ring, removing a particular key can be difficult without removing more than just the desired key. Accordingly, there is a need for a key that is removable from a key ring.

Several patents show keys with various releasable shackles: for example, Amrhein, U.S. Pat. No. 1,852,950; Rossi U.S. Pat. No. 3,481,169; and Denney, U.S. Pat. No. 4,176,534. Each of the prior-art keys show complicated, expense to make, and difficult to use release mechanism.

Accordingly, a need exists for an easy to use and inexpensive to operate key with releasable shackle.

BRIEF SUMMARY OF THE INVENTION

An object of the invention is to provide a key with a releasable shackle that overcomes the disadvantages of the devices of this general type and of the prior art.

With the foregoing and other objects in view there is provided, in accordance with the invention, a key assembly for releasably attaching to a closed loop. A closed loop can be key ring or key chain. A closed loop can include an openable ring that is merely inconvenient to open so as to make it effectively a "closed loop".

The key assembly includes a key with many parts shared with a typical key.

The key assembly includes a shackle that has a gap. That is the shackle of the key does not form a closed loop.

An openable gate acts to span the gap in order to create an openable shackle. The gate is opened to allow the key assembly to be placed on a loop (e.g. a key ring).

The gate be a wire gate. The wire gate includes an offset loop wire loop that has been cut. The ends of the cut loop are inserted into two holes drilled into the key. A hole that is closer to the gap is a "proximal" hole. The hole that is farther from the gap is a "distal" hole. The holes are formed from the front through the back of the key or shackle. The holes are formed coplanar with the gate when the gate is in its closed position abutting the shackle or key. The wire gate has a proximal leg that is inserted in the proximal hole. A proximal arm of the gate is connected to the proximal leg. A distal leg inserts in the distal hole. A distal arm connects to the distal leg. The distal arm may connect directly with the proximal arm or an intervening span or piece may be included. The intervening piece can be termed a "shoulder" and can be used to abut the shackle or the bow. The holes can be formed in the bow of the key or in the shackle. The configuration of the holes combined with the flexible resilient material of the gate (i.e. extruded aluminum wire, steel, or resin), tends to cause the gate to move inline with the holes where the gate abuts the shackle or bow to close shackle. The gate can be deflected inward to an open position by applying pressure against it. When deflected, the key can be added or removed from a key ring.

In accordance with a further object of the invention, the gap between the shackle and the bow are spaced by a distance that is less than the length of the gate. This allows the gate to span the gap and to releasably close the shackle.

In accordance with a further object of the invention, the deflectable gate can be formed by placing a spring-loaded, hinged gate across the gap. A shoulder on the shackle or bow acts as a surface for the hinged gate to abut. A spring in the gate presses toward the hinge and tends to keep the gate closed. The gate has a foot that abuts the shoulder. A notch on the gate or the shoulder can receive a complementary part on the gate or shoulder to help the gate seat in a closed position. To open the gate, force is applied inward against the gate to overcome the action of the spring.

In accordance with a further object of the invention, the gate can be made of a flexible resilient material. An example of a suitable material is a flat extruded aluminum wire. The gate is fixed to the bow or shackle on one side and abuts the bow or shackle on its other side. The shape and material of the gate tend to keep the gate closed. The shoulder where the gate abuts and releases from can include a notch to receive the gate when the gate is closed. The end that is fixed to the key can be inserted, screwed, or formed with the material to fasten the gate. To open the gate, the gate is pressed inward to disengage the abutting end from the key and to allow the key to be placed on a ring.

In accordance with a further object of the invention, the gate can be formed from two pieces of resilient material. One piece of the gate is fixed to each side of the gap. The pieces of material overlap to close the gap. The pieces are pressed inward to form an opening.

In accordance with a further object of the invention, the gate is formed as a cuff. The cuff extends over the shoulder when the gate is in a closed position. A spring urges the cuff to be extended an in a closed position. To open the gate, the spring is compressed by sliding the cuff from the cuff shoulder to expose the gap. The gate can include an internal bushing to allow the gate to be screwed onto an external thread on the shackle shoulder.

Other features that are considered as characteristic for the invention are set forth in the appended claims.

Although the invention is illustrated and described herein as embodied in a key with a releasable shackle, the invention should not be limited to the details shown in those embodiments because various modifications and structural changes may be made without departing from the spirit of the invention while remaining within the scope and range of equivalents of the claims.

The construction and method of operation of the invention and additional objects and advantages of the invention is best understood from the following description of specific embodiments when read in connection with the accompanying drawings.

DETAILED DESCRIPTION OF THE INVENTION

Figure 1:
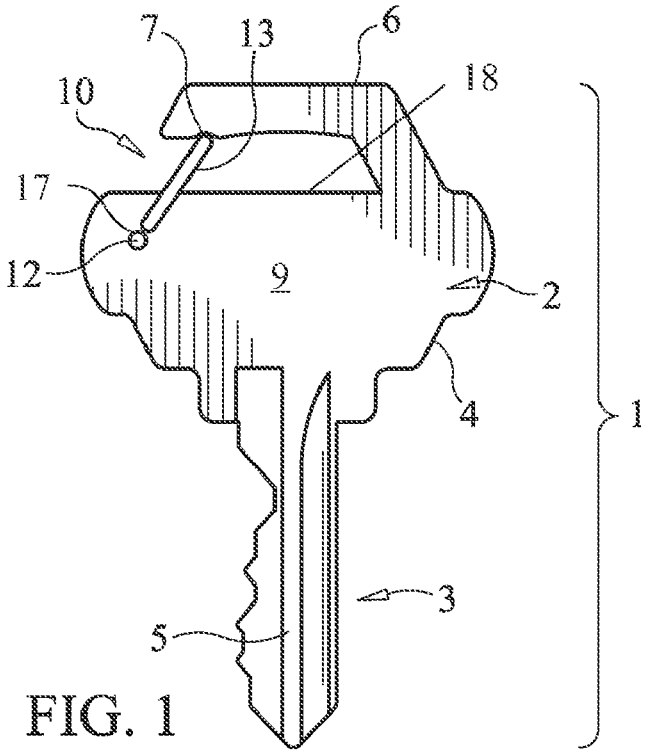
FIG. 1 is a diagrammatic font side view of a wire gate embodiment of a key assembly according to the invention shown in a closed position.
Figure 2:
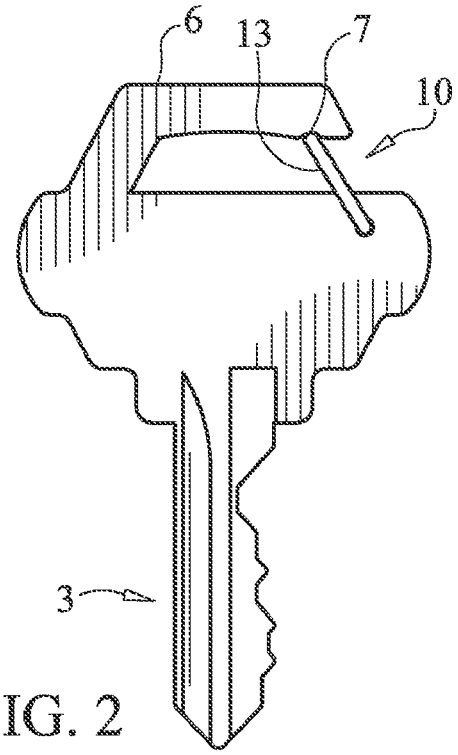
FIG. 2 is rear side view of the wire gate embodiment shown in FIG. 1.

FIGS. 1-5 show an embodiment of a key 1 with a gate 10. The key 1 includes a proximal bow 2 and a distal blade 3. The blade 3 is inserted in a keyhole to unlock a lock, which is not shown. The bow 2 is used to hold and turn the key when the key 1 is being inserted in a lock and when the key 1 is being turned within a lock. The bow 6 includes a bow body 9 and a shackle 6. The shackle is fixed on one side to the bow body 9. As shown in FIGS. 1-2, a loop 18 is defined by the bow body 9, the shackle 6, and the gate 10, when the gate is in the closed position. The key 1 can be connected to a key ring by threading the key ring through the loop 18.

Figure 5A:
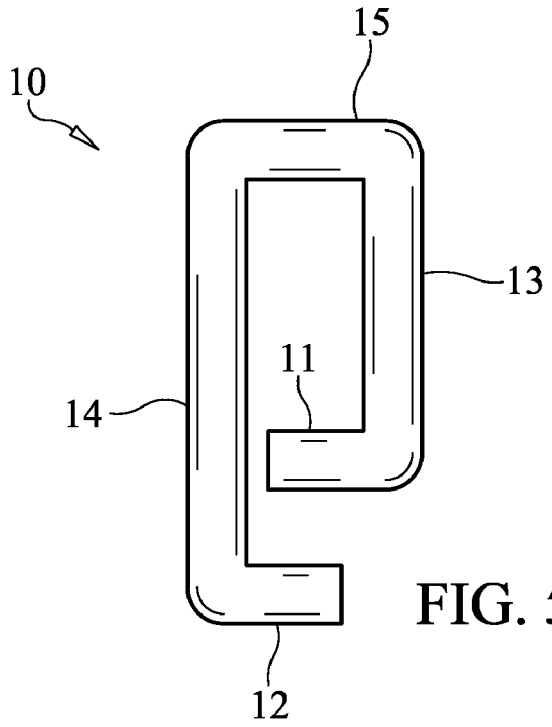
FIG. 5A is a top side view of a wire gate.
Figure 5B:
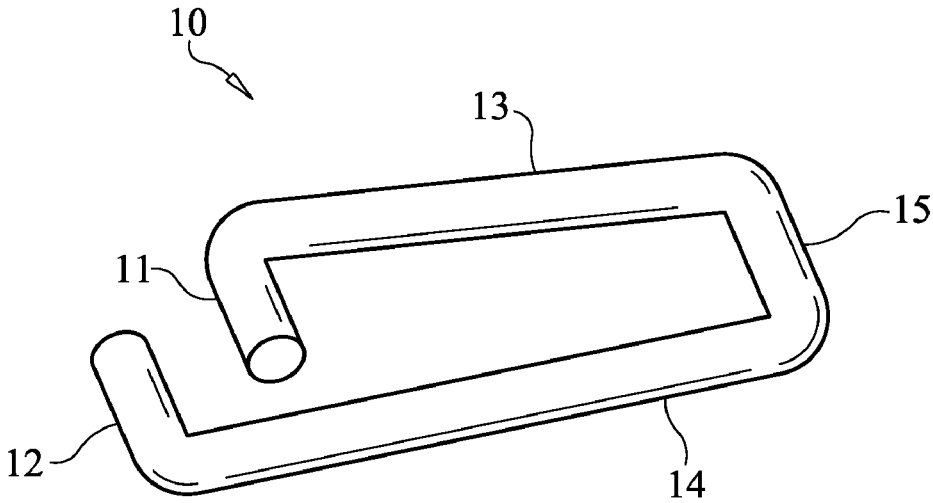
FIG. 5B is a perspective view of the wire gate.

A preferred embodiment of the gate 10, also known as a wire gate, is shown in FIGS. 5A and 5B. The gate 10 is preferably made of steel wire but can be made of other flexible, resilient materials such as aluminum or resin. The gate 10 has a proximal leg 11 and a distal leg 12. The proximal leg 11 is connected to a proximal arm 13 and extends inward from the proximal arm 13. The distal leg 12 is connected to the distal arm 14 and extends inward from the distal arm 14. A central shoulder 15 interconnects the proximal arm 13 and the distal arm 14.

In the embodiment shown in FIGS. 1-5, a proximal socket 16 and a distal socket 17 are formed in the bow body 9. The proximal socket 16 and the distal socket 17 are aligned with the gate 10 when the gate is in the closed position; see FIGS. 1 and 2. The proximal leg 11 of the gate 10 is inserted in the proximal socket 16. The distal leg 12 of the gate is inserted in the distal socket 17.

The shackle 6 includes an abutment 7 for the gate 10. A preferred embodiment of the abutment 7 is an arcuate surface. When the gate 10 is in the closed position, the shoulder 15 of the gate 10 rests against the abutment 7.

Figure 3:
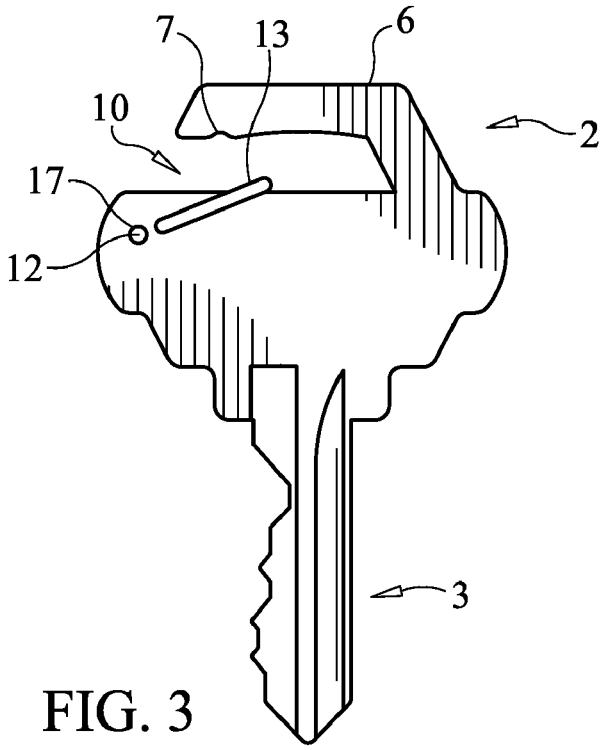
FIG. 3 is a front side view of the wire gate embodiment shown in FIG. 1 while in an opened position.
Figure 4:
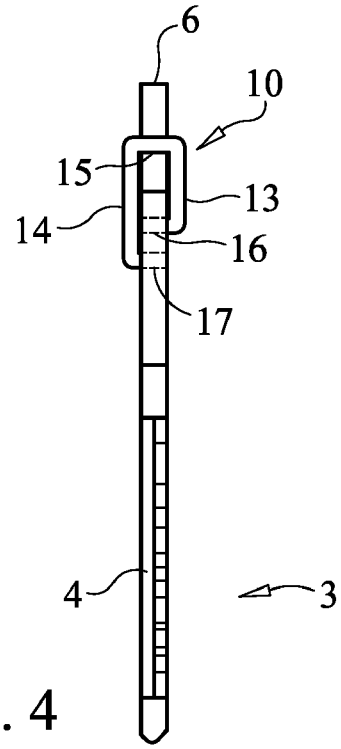
FIG. 4 is a right side view of the wire gate embodiment shown in FIG. 1.

To operate the gate 10, the gate is pressed inward to the position shown in FIG. 3. The configuration and materials of the gate 10 cause the gate to tend to return from the open position to the closed position. To insert a key ring into the loop 18, a key ring is pressed inward against the gate. Once the gate 10 has been passed by the key ring, the gate snaps back to a closed position. The inward angled position of the gate 10 prevents the gate from opening outward. Accordingly, the gate 10 tends to stay closed unless pressed from the outside. To release a key ring, the gate 10 is deflected inward and then the key ring is passed through the open gate.

To form the key 1, a key 1 can be forged with the open shackle 6. The proximal socket 16 and distal socket 17 can be drilled into the bow body 9. Then, the proximal leg 11 is inserted in the proximal socket 16 and the distal leg 12 is inserted in the distal socket 17.

In an alternate embodiment of a method of manufacturing, a traditional key has the shackle cut. A proximal socket 16 is drilled in the bow body 9 and a distal socket 17 is drilled in the bow body. Then, the proximal leg 11 is inserted in the proximal socket 16 and the distal leg 12 is inserted in the distal socket 17.

Figure 6:
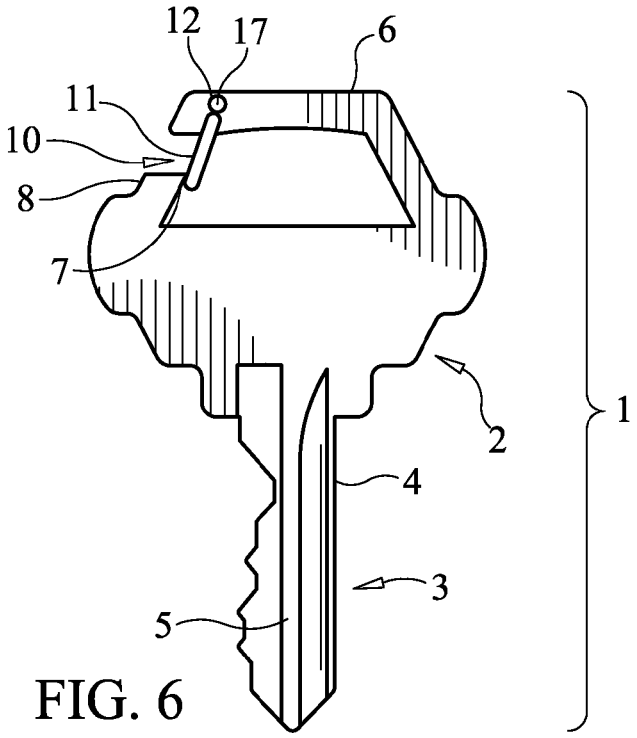
FIG. 6 is a top side view of a wire gate embodiment of the invention with the wire gate inserted in a shackle.

FIG. 6 shows an embodiment where the proximal socket 16 and the distal socket 17 are formed in the bow body 9. The proximal leg 11 and distal leg 12 of the gate 10 are inserted in the proximal socket 16 and distal socket, respectively. A bow shoulder 8 is formed on the bow body 9. The abutment 7 is located on the bow shoulder 89. The gate 10 extends from the shackle to the abutment 7 to form the loop 18.

Figure 7:
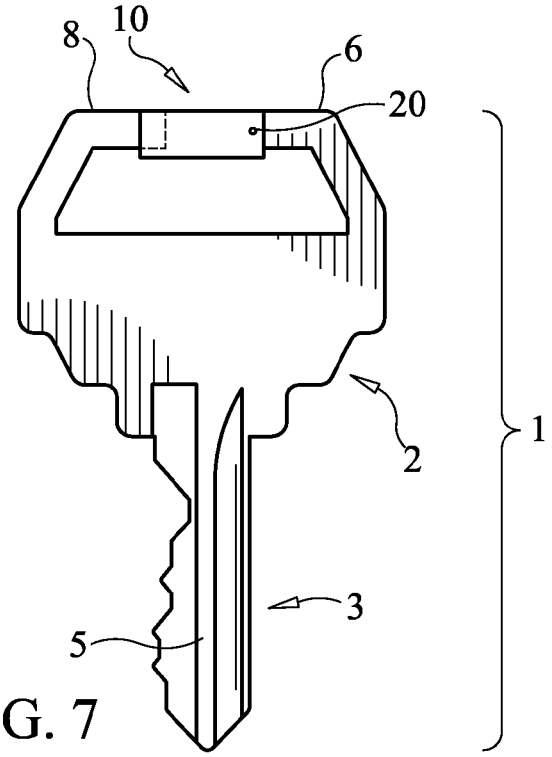
FIG. 7 is a top side view of a hinged gate embodiment of the invention.
Figure 8:
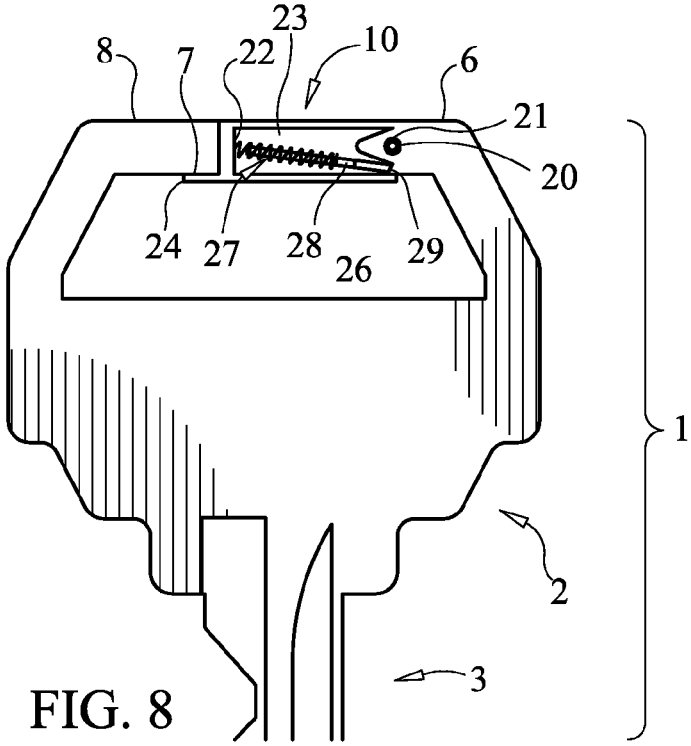
FIG. 8 is a front sectional view of the hinged gate embodiment taken along section line VIII-VIII in FIG. 7.
Figure 9:
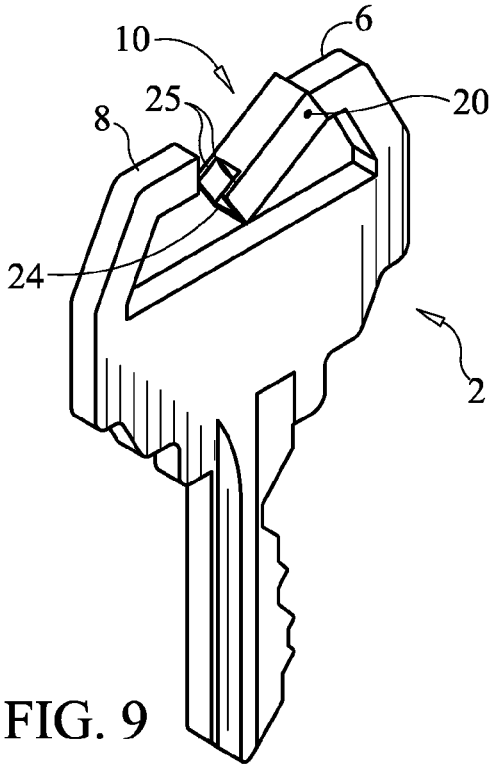
FIG. 9 is a perspective view of the hinged gate embodiment shown in FIG. 7 with the gate in an opened position.

FIGS. 7-9 show an embodiment of the key assemble that uses a spring-loaded, hinged gate 10. The gate 10 releaseably connects the shackle 6 to the bow shoulder 8. As shown in FIG. 7, in a closed position, the gate 10 spans from the shackle 6 to the bow shoulder 8 to form a loop 18. The gate 10 is connected to the shackle 6 with a hinge 20. The shackle 6 has a notch 29 formed in its distal end. The gate 10 seats on the bow shoulder 8 by having a socket formed from a foot 25 and two lateral walls 25. A spring assembly 27 is formed by placing a spring 23 on a pin 26. A proximal end of the pin 26 rests in the notch 29. The pin 26 has a shoulder 28. The spring assembly 27 is placed within the gate 10. The spring assembly 27 presses against a gate-spring abutment 27 and the shoulder 6 to push the gate to a closed position as shown in FIGS. 7-8. To open the gate 10 as shown in FIG. 9, the gate 10 is pressed downward.

Figure 10:
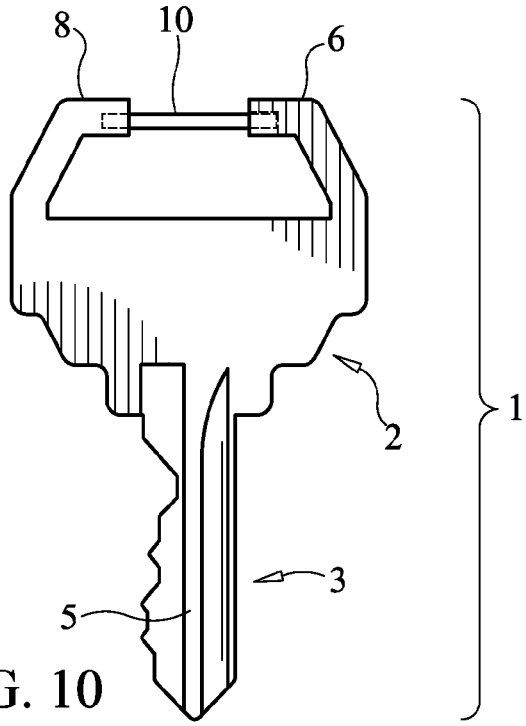
FIG. 10 is a front side view of a flexible resilient gate embodiment with the gate in a closed position.
Figure 11:
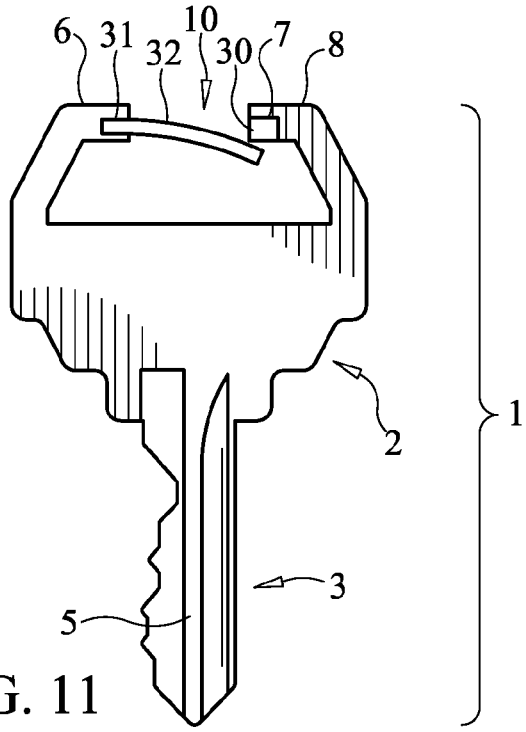
FIG. 11 is a front section view of the flexible resilient gate embodiment shown in FIG. 10 shown in an open position and taken along line XI-XI.

FIGS. 10-11 show a flexible resilient gate embodiment. The gate 10 is made of a flexible resilient material, for example, a steel wire or resin piece. The gate 10 is fixed to the shackle 6 and extends to the bow shoulder 8. The gate includes an embedded portion 31 and an exposed portion 32. The embedded portion 31 is embedded within the shackle 6. The tip of the exposed position 32 abuts the bow shoulder 8. The tip of the exposed portion 32 can seat within a notch in the bow shoulder. The notch includes lateral walls 30 and an abutment 7. The gate 10 rests against the abutment 7 when the gate is closed as shown in FIG. 10. To open the gate 10, the gate is pressed to unseat the gate from the bow shoulder 8. The resilient nature of the gate 10 returns the gate 10 to the seated position.

Figure 12:
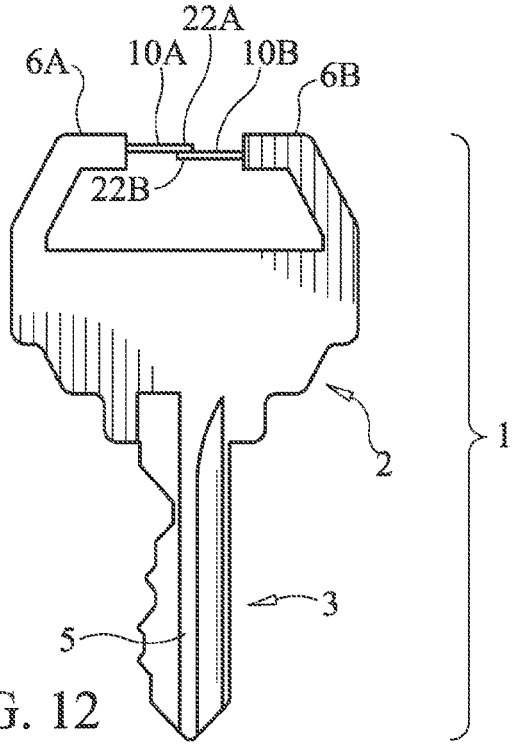
FIG. 12 is a front side view of a flexible resilient two-piece gate embodiment.

FIG. 12 shows an embodiment that includes two gate portions 10A and 10B that overlap and release. Each gate portion 10A and 10B is made from a flexible resilient material. Gate portion 10A is embedded within a first shackle 6A. Gate portion 10B is embedded within a second shackle 6B. An exposed tip 22A of the gate portion 10A overlaps an exposed tip 22B of the gate portion 10B when the gate is closed. To open the gate, the gate portions 10A and 10B are flexed to create a gap between the gate portion 10A and 10B. The resilient material of the gate portions 10A and 10B causes the gate portions to tend to return to the closed position that is shown in FIG. 12.

Figure 13:
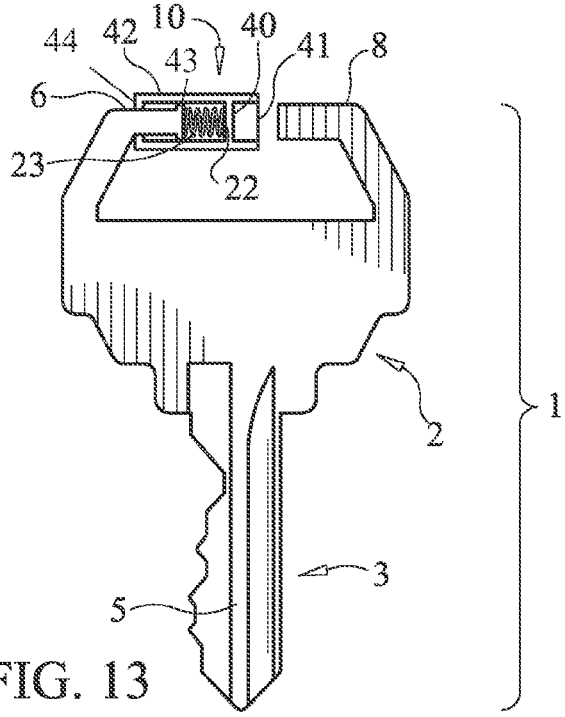
FIG. 13 is a sectional front side view of a spring-loaded cuff embodiment.

FIG. 13 shows a spring-loaded cuff embodiment of the key assembly. In this embodiment, a span between the shackle 6 and the bow shoulder 8 is spanned by a gate 10 that includes a cuff. The gate 10 includes a gate-shoulder cuff 41 that seats on the gate shoulder 8 when the gate 10 is in a closed position. The gate 10 further includes a gate-shackle cuff 42 that rides along the shackle when moving from a closed position to an open position. A spring 23 presses against a gate-spring abutment 22 inside the cuff and against the shackle 6 to urge the gate to a closed position. A shackle flange 43 and a cuff flange 44 prevent the gate 10 from separating from the shackle 6.

Figure 14:
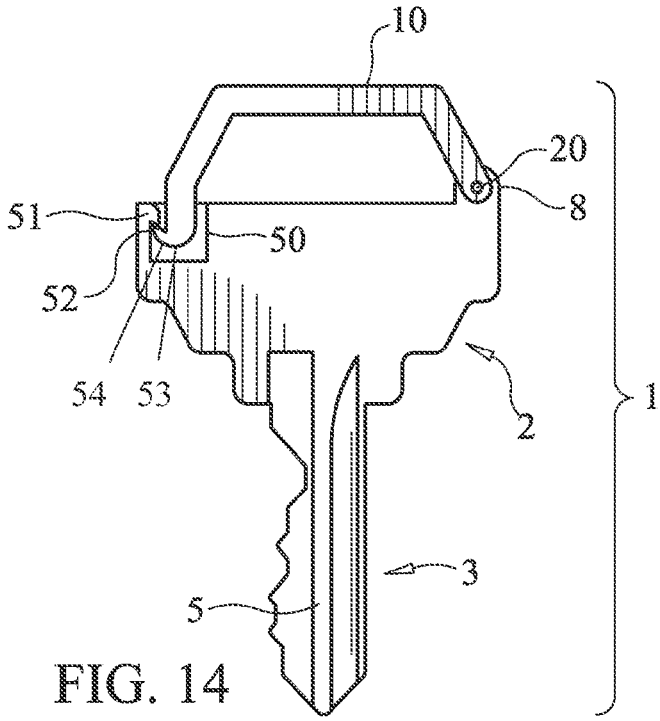
FIG. 14 is a sectional front side view of a hinged shackle embodiment.

FIG. 14 shows an embodiment with a flexible gate 10. The gate 10 is connected at a proximal end 55 to the bow shoulder 8 with a hinge. The gate 10 is made of a flexible resilient material such as aluminum, steel, or a resin. The distal end 53 of the gate has a barb 54. The bow body 9 has a recess 50 formed therein with a catch 51. The recess 50 is wide enough and deep enough to accommodate the distal end 53 and the barb 54. When the distal end 53 is inserted within the recess 50, the barb 52 engages the catch 51 to lock the gate closed. To open the gate 10 the gate 10 is squeezed to disengage the barb 52 from the catch 51 and then the distal end 53 is removed from the recess 50.

Figure 15:
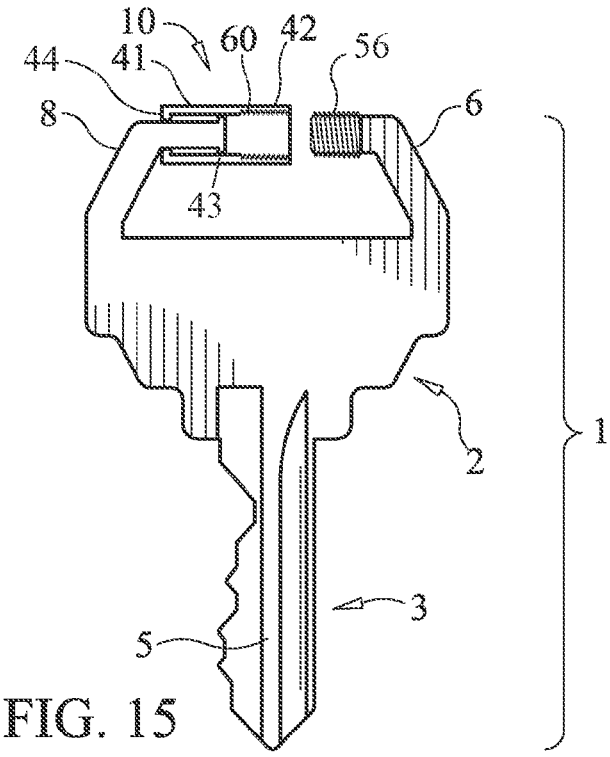
FIG. 15 is a sectional front side view of a threaded cuff embodiment.

FIG. 15 shows a threaded cuff embodiment. The gate 10 slides along the shackle 6 to reach the bow shoulder 8. The bow shoulder 8 has an external thread 16. The gate includes a bushing 60 that engages the external thread 56 when the gate 10 is in a closed position. The shackle 6 includes a shackle flange 43. The gate 10 includes a cuff flange 44. The shackle flange 43 and cuff flange 44 allow the gate to travel along the shackle 6 but not to allow the gate 10 to separate from the shackle 6. To close the gate 10, the gate is pulled toward the bow shoulder 8 and then screwed onto the thread 56 of the bow shoulder. To open the gate 10, the bushing 60 is unscrewed from the thread 56 and the gate 10 is pushed along the shackle 6 and away from the bow shoulder.

Although the invention is shown in the several figures and embodiments, the scope of the invention is described by the claims and their equivalents.

What is claimed is:

1. A key assembly for releasably attaching to a closed loop, comprising:

a key having a blade and a bow, said blade being configured to insert into a keyway of a lock and said bow being connected to said blade and being configured to grasp and rotate said blade within the keyway;

a shackle being connected to said bow;

a gate having a proximal leg, a proximal arm, a distal arm, and a distal leg, said proximal leg being connected to said proximal arm and extending laterally inward from said proximal arm, said distal leg being connected to said distal leg and extending laterally inward from said distal arm, said proximal arm and said distal arm being connected;

said proximal leg and said distal leg being inserted in only one of said bow and said shackle, and said proximal leg and said distal leg abutting the other of said bow and said shackle;

said proximal leg and said distal leg being rotatably operatable within said only one of said bow and said shackle to move said gate out of abutment with said other of said bow and said shackle;

said proximal leg and said distal leg being inserted within said bow; and said bow having a proximal socket and a distal socket formed therein, said proximal leg being rotatable within said proximal socket, and said distal leg being rotatable within said distal socket.

2. The key assembly according to claim 1, wherein said gate includes a shoulder interconnecting said proximal arm and said distal arm, said shoulder being configured to abut said other of said bow and said shackle.

3. The key assembly according to claim 1, wherein said shackle and said bow are spaced apart by a distance and said gate has a length greater than said distance.

4. A key assembly for releasably attaching to a closed loop, comprising:

a key having a blade and a bow, said blade being configured to insert into a keyway of a lock and said bow being connected to said blade and being configured to grasp and rotate said blade within the keyway;

a shackle being connected to said bow;

a gate having a proximal leg, a proximal arm, a distal arm, and a distal leg, said proximal leg being connected to said proximal arm and extending laterally inward from said proximal arm, said distal leg being connected to said distal leg and extending laterally inward from said distal arm, said proximal arm and said distal arm being connected;

said proximal leg and said distal leg being inserted in only one of said bow and said shackle, and said proximal leg and said distal leg abutting the other of said bow and said shackle;

said proximal leg and said distal leg being rotatably operatable within said only one of said bow and said shackle to move said gate out of abutment with said other of said bow and said shackle; and said gate being only inwardly deflectable from an abutting position, said abutting position being when said gate is abutting said other of said shackle and said bow.

* * * * *